US007943881B2

(12) United States Patent
Gimeno et al.

(10) Patent No.: US 7,943,881 B2
(45) Date of Patent: May 17, 2011

(54) GROUNDING DISCONNECTOR AND A METHOD OF MANUFACTURING SUCH A GROUNDING DISCONNECTOR

(75) Inventors: Carmelo Gimeno, Aarau (CH); Gerardo Palmieri, Oberentfelden (CH); Max Hauri, Kirchleerau (CH)

(73) Assignee: Areva T&D AG, Oberentfelden (CH)

( * ) Notice: Subject to any disclaimer, the term of this patent is extended or adjusted under 35 U.S.C. 154(b) by 496 days.

(21) Appl. No.: 12/083,513

(22) PCT Filed: Oct. 12, 2006

(86) PCT No.: PCT/EP2006/067318

§ 371 (c)(1),
(2), (4) Date: Apr. 11, 2008

(87) PCT Pub. No.: WO2007/042548

PCT Pub. Date: Apr. 19, 2007

(65) Prior Publication Data

US 2009/0120909 A1 May 14, 2009

(30) Foreign Application Priority Data

Oct. 14, 2005 (FR) ..... 05 53130

(51) Int. Cl.
*H01H 33/70* (2006.01)

(52) U.S. Cl. ..... 218/79; 218/78; 218/80

(58) Field of Classification Search ..... 218/1–14, 218/44, 45, 67–71, 78–80, 84, 118–120, 218/140, 152–154

See application file for complete search history.

(56) References Cited

U.S. PATENT DOCUMENTS

| | | | | |
|---|---|---|---|---|
| 5,134,542 | A | 7/1992 | Suzuyama et al. | |
| 6,559,403 | B2 * | 5/2003 | Gutalj | 218/79 |
| 6,783,406 | B2 | 8/2004 | Keiser et al. | |
| 6,995,330 | B2 * | 2/2006 | Gimeno | 218/79 |
| 2001/0025828 | A1 | 10/2001 | Gutalj | |
| 2004/0042158 | A1 | 3/2004 | Otsuka et al. | |
| 2005/0201028 | A1 | 9/2005 | Inami et al. | |

FOREIGN PATENT DOCUMENTS

| | | |
|---|---|---|
| DE | 2821049 | 11/1979 |
| DE | 3109669 | 11/1982 |
| DE | 19816592 | 10/1999 |
| EP | 1361633 | 11/2003 |
| EP | 1507274 | 2/2005 |
| FR | 2811147 | 1/2002 |
| JP | 56116810 | 9/1981 |
| JP | 7123549 | 5/1995 |
| WO | 2005018066 | 2/2005 |

* cited by examiner

*Primary Examiner* — Renee Luebke
*Assistant Examiner* — Marina Fishman
(74) *Attorney, Agent, or Firm* — Nixon Peabody LLP

(57) ABSTRACT

An assembly for a grounding disconnector, a grounding disconnector including the assembly and a method of manufacturing a grounding disconnector are described. The assembly includes a stationary grounding contact (12), a phase contact (14) suitable for being connected electrically to a busbar (8), moving connection means (16) suitable for putting the stationary grounding contact (12) and the phase contact (14) into electrical contact with each other, the stationary grounding contact (12), the phase contact (14) and the moving connection means (16) being mounted on a mounting plate (6).

17 Claims, 3 Drawing Sheets

GROUNDING DISCONNECTOR AND A METHOD OF MANUFACTURING SUCH A GROUNDING DISCONNECTOR

CROSS REFERENCE TO RELATED APPLICATIONS OR PRIORITY CLAIM

This application is a national phase of International Application No. PCT/EP2006/067318 entitled "GROUND DISCONNECT SWITCH AND METHOD FOR MAKING SAME", which was filed on Oct. 12, 2006, and which claims priority of French Patent Application No. 05 53130, filed Oct. 14, 2005.

TECHNICAL FIELD AND PRIOR ART

The present invention relates mainly to grounding disconnectors used in metal-enclosure gas-insulated electrical switchgear, in particular three-phase electrical switchgear with common enclosure, and to a method of manufacturing such a disconnector.

The invention is particularly applicable to a very high speed grounding disconnector, that type of disconnector having a very short switching time and being capable of grounding live conductors carrying current.

A grounding disconnector generally comprises enclosure closed in gastight manner and filled with a dielectric gas, at least one assembly received in the enclosure comprising a stationary grounding contact, a phase contact, and a switch element serving for electrically connecting together the grounding contact and the phase contact, so as to ground the phase contact.

For example, such a disconnector is known from Document JP 56-116810, in which the switch element is mounted to move in translation along an axis connecting the stationary grounding contact to the phase contact. The stationary grounding contact is fastened to a plate closing off an opening provided in a cylindrical wall of the enclosure of the disconnector. The switch element is actuated by an actuator device fastened to the inside face of the enclosure.

Such a disconnector suffers from the drawback of taking a long time to manufacture because the stationary grounding contact and the switch element are assembled in two stages. In addition, it is complex to fasten the switch element to the inside wall.

Document WO 2005/018066 discloses another type of disconnector, comprising a stationary grounding contact, a phase contact, and a switch element, the grounding contact being offset relative to the axial direction of movement of the switch element. That disconnector is relatively voluminous.

Document EP 1 507 274 also discloses a grounding disconnector in which the stationary grounding contact, the switch element, and its actuator device are assembled on a common plate which is itself fastened to the enclosure of the disconnector.

That switch element is suitable for pivoting about an axis that is substantially parallel to the axis interconnecting the stationary grounding contact and the phase contact, and said switch element moves in a plane perpendicular to said axis. That switch element is of relatively complex shape.

Document US2004/0042158 discloses a grounding disconnector in gastight enclosure comprising an enclosure and a plate on which a grounding plate and two electrodes, each being connected to a conductor, are mounted. A mobile contact can move orthogonally to the plate. The distance between the mounting plate and the second moving contact is quite large; the disconnector is then not compact.

An object of the present invention is thus to provide a grounding disconnector that is simple to manufacture and easier to maintain.

Another object of the present invention is to provide a grounding disconnector that is compact.

SUMMARY OF THE INVENTION

The above-mentioned objects are achieved by a grounding disconnector comprising enclosure and a cover designed to define a tight space, at least a stationary grounding contact, a phase contact, and a switch element being mounted on the cover, thus making it possible for pre-assembly to be performed before the cover is mounted on the enclosure.

In other words, the grounding disconnector comprises a mounting plate provided with a stationary grounding contact, with a phase contact, and with a switch element suitable for electrically connecting together the grounding contact and the phase contact, and enclosure provided with a busbar, the phase contact coming to be electrically connected to the busbar. Thus, a subassembly can be pre-assembled, and then fastened to the enclosure, the electrical connection between the busbar and the phase contact being designed to be automatic on mounting the mounting plate onto the enclosure.

Furthermore, an actuator mechanism for actuating said switch element can also be pre-fastened to the mounting plate.

This disconnector offers the advantage of having a relatively plane configuration due to the various contacts being disposed in a plane that is substantially parallel to the mounting plate. In addition, it is simpler to assemble it and to isolate the inside of the disconnector in tight manner from the outside environment.

The present invention thus mainly provides an assembly for a grounding disconnector, said assembly comprising a stationary grounding contact, a phase contact suitable for being connected electrically to a busbar, moving connection means suitable for putting the stationary grounding contact and the phase contact into electrical contact with each other, the stationary grounding contact, the phase contact and the moving connection means being mounted on a mounting plate.

The phase contact advantageously has a connector for electrically connecting together the phase contact and the busbar.

In a particular embodiment, the assembly of the present invention comprises an actuator device for actuating the moving connection means mounted on the mounting plate, said assembly further comprising a pivot shaft suitable for being caused to move by the actuator device, said pivot shaft being mounted substantially perpendicularly to the mounting plate, said assembly further comprising a connecting rod mechanism connected via a first end to the shaft and via another end to the moving connection means so as to transform the pivotal movement of the shaft into a movement in translation of the moving connection means.

Advantageously, the moving connection means and the connecting rod mechanism lie in a plane that is substantially parallel to the mounting plate.

In an embodiment, the moving connection means comprise a rod, the stationary grounding contact comprises a passageway for slidably receiving the rod, and the phase contact comprises a cavity for receiving one end of the rod.

The rod may be made of silver-plated copper, and one end of the rod that is designed to come into contact with the phase contact may be made of a material that withstands electrical arcs, such as a copper-tungsten alloy.

Advantageously, the phase contact comprises a tulip-shaped connecting element mounted in the cavity of the phase contact. The grounding contact can also have a tulip-shaped connection element mounted in the passageway, said connection element being made of an elastic conductive material, such as a copper-chromium alloy.

Said tulip-shaped connection element is fastened by being screwed into the passageway in the grounding contact.

The grounding contact may also have a guide sleeve disposed inside the tulip-shaped connection element, said guide sleeve being held by being clamped between the tulip-shaped connection element and a ring screwed onto said tulip-shaped element.

The guide sleeve is, for example, made of a thermoplastic material.

When the disconnector is a three-phase disconnector, the assembly of the present invention comprises three stationary grounding contacts associated with respective phase contacts and with respective moving connection means, said moving connection means being suitable for moving along parallel axes.

Advantageously, a single actuator mechanism is provided for all three of the moving connection means. However, it is also possible to imagine having one actuator mechanism for each of the moving connection means.

The present invention also provides a gas-insulated grounding disconnector comprising a casing, at least one busbar, and at least one assembly of the present invention, closing off an opening in the casing in tight manner.

The busbar may have a connection portion for connection to the phase contact.

The present invention also provides a method of manufacturing a grounding disconnector comprising the following steps:

a) mounting at least one stationary grounding contact, at least one phase contact, and at least one moving connection means onto a mounting plate; and b) fastening said mounting plate onto a casing.

The manufacturing method of the present invention may further comprise:

during step a), mounting an actuator device for actuating the moving connection means onto the mounting plate;

during step b), automatically electrically connecting said phase contact to a busbar contained in the casing, and/or putting in place sealing means between the mounting plate and the casing.

BRIEF DESCRIPTION OF THE DRAWINGS

The present invention will be better understood on reading the following description and on examining the accompanying drawings, in which.

DETAILED DESCRIPTION OF PARTICULAR EMBODIMENTS

The present invention is applicable both to single-phase grounding disconnectors and to three-phase disconnectors.

A three-phase grounding disconnector is described below.

Figure 1:
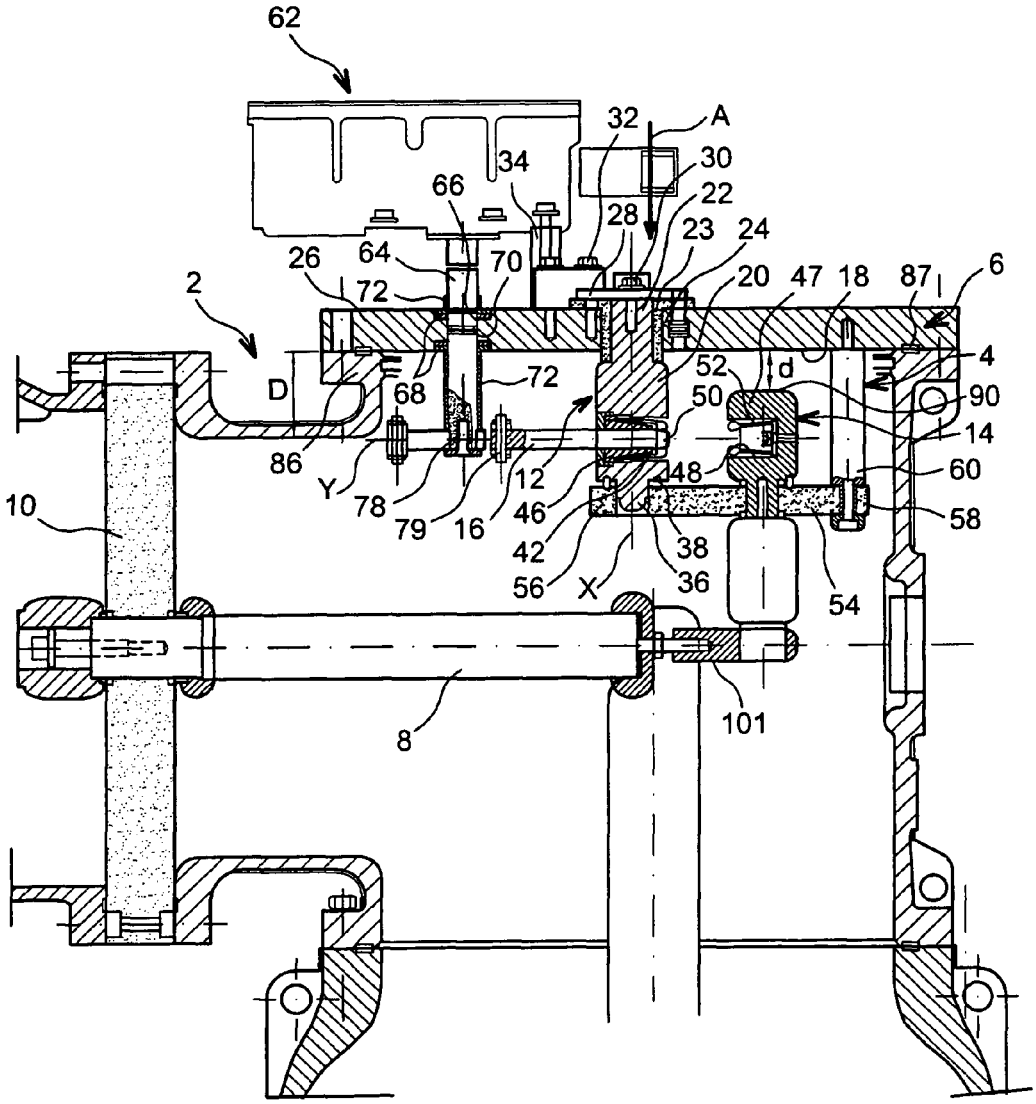
FIG. 1 is a cross-section view of a disconnector of the present invention.

FIG. 1 shows a grounding or ground disconnector having a casing 2 provided with an opening 4 making it possible to access the inside of the casing 2.

In the example shown, the opening is circular, but it is possible to provide an opening that is polygonal, e.g. that is square in shape.

The disconnector also has a cover 6 formed by a plate, designed to close off the opening 4 in tight manner, in order to co-operate with the casing 2 to define a tight enclosure designed to contain a dielectric gas. In the description below, said plate 6 is referred to as the "mounting plate".

The casing 2 and the plate 6 can, for example, be made of aluminum.

The casing 2 has three busbars 8 (only one of which is shown in FIG. 1) that are disposed substantially parallel to one another and held inside the casing 2 via a plate 10 made of an insulating material. The busbars 8 are, for example, disposed in the same plane or in a triangular configuration.

The grounding disconnector also has means for grounding each of the busbars 8. For each busbar, these means comprise a grounding contact 12, a phase contact 14, and electrical connection means 16 mounted to move between the grounding contact 12 and the phase contact 14.

In the present invention, the grounding contact 12, the phase contact 14 and the moving connection means 16 are mounted on an inside face 18 of the mounting plate 6, thereby making it possible for the grounding assembly to be pre-assembled before the casing is closed.

For a three-phase grounding disconnector, said disconnector has, in the example shown, the same three grounding means. Therefore, the grounding means associated with one busbar are described below.

The stationary grounding contact 12 has a rod 20 mounted via a first end 22 in a passageway 24 provided with the mounting plate 6. In the example shown, the rod 20 is substantially perpendicular to the mounting plate 6.

Said rod 20 is, for example, secured to the mounting plate 6 by means of a set of bolts screwed directly into bores provided in an outside face 26 of the mounting plate 6.

Figure 3:
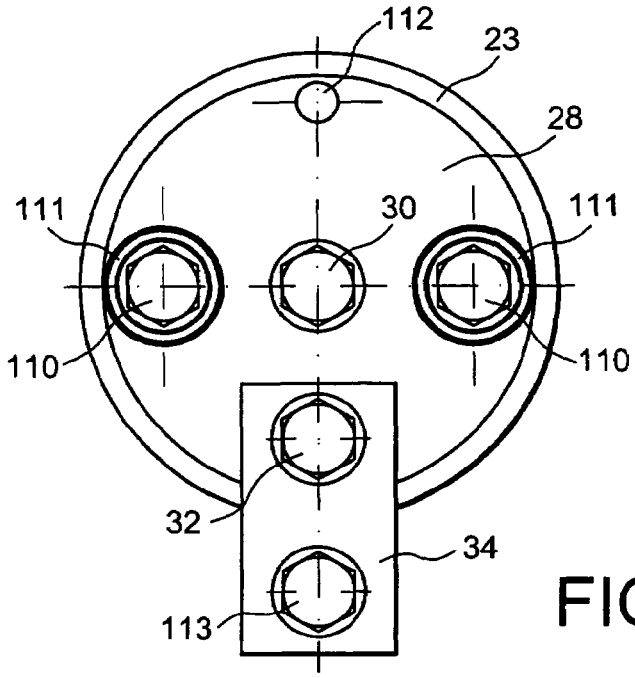
FIG. 3 is a view from above of a detail indicated by arrow A in FIG. 1.

In the example shown in detail in FIG. 3, a small plate 28 is fastened to the end 22 of the rod 20 by a bolt 30, and said small plate 28 is secured to the mounting plate 6 by bolts 110. The small plate 28 is disk-shaped and is connected to ground via a link 34. Said link 34, in the form of a rectangular small plate, is fastened via one end to the small plate 28 by means of a bolt 32, and via its other end to the plate 6 by means of a bolt 113. An electrically conductive spacer (not visible) is provided between the plate 6 and the link 34. Other fastening means for fastening the elements 28, 34, and 6 together can be devised.

Advantageously, a sleeve 23 made of an insulating material is disposed between the wall of the passageway 2 and the assembly made up of the rod 20 and of the small plate 28 so as to insulate the grounding contact 12 from the mounting plate 6. An insulating sleeve is also provided between the bolt 111 and the plate 6 (FIG. 3).

This configuration advantageously makes it possible to measure the current in the grounding contact 12.

Inside the casing 2, the grounding rod 20 is provided with a through passageway 38 whose axis Y is substantially orthogonal to the main axis of the rod 20, enabling a connection element forming the moving connection means 16 to pass through. The connection element is in the form of a rod in the example shown.

The rod 16 is mounted to move along the axis Y between a first position (shown in uninterrupted lines in FIG. 2) in which the grounding contact 12 and the phase contact 14 are isolated from each other and a second position (shown in dashed lines in FIG. 2) in which the grounding contact 12 and the phase contact 14 are connected together.

The rod 16 is made, for example, of silver-plated copper, and its end 50 that is designed to come into contact with the phase contact is made of a material that withstands electric arcs, such as a copper and tungsten alloy.

In the first position, the rod 16 is held in the passageway 38.

Figure 4:
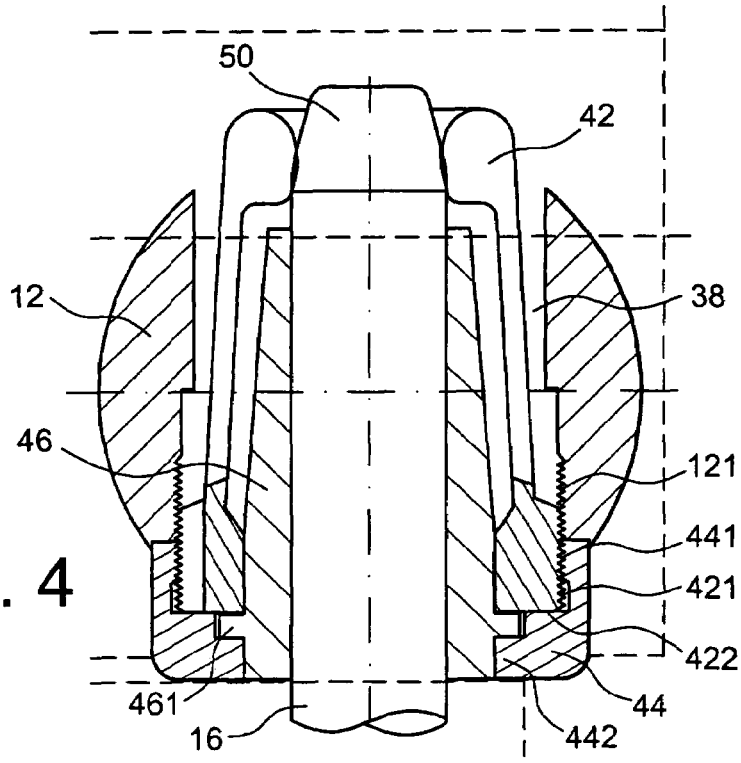
FIG. 4 is a detail view of a grounding contact of the disconnector of FIG. 1.

In advantageous manner, as can be seen in FIG. 4, a tulip-shaped contact element 42 is mounted in the passageway 38. The particular shape of the connection element 42 makes it possible to accommodate alignment faults and thus to guarantee permanent electrical contact between the rod 16 of the moving connection means and the grounding contact 12. The element 42 is made of an elastically deformable and electrically conductive material, e.g. of an alloy of copper and of chromium.

A guide sleeve 46 is disposed, advantageously inside the tulip-shaped element, in order to improve the axial guiding of the rod 16. The sleeve 46 has an inside diameter that is substantially equal to the diameter of the rod 16, and an outside diameter that is less than the diameter at rest of the tulip-shaped element 42. Said sleeve 46 is also made of an insulating material that offers good sliding properties, and that is more flexible than the material from which the rod 16 is made, e.g. a thermoplastic material, e.g. polyethylene-terephthalate. The guide sleeve 46 is of length sufficient to prevent the rod 16 from jamming. For example, the guide sleeve 46 has a length equal to 2 to 3 times the diameter of the rod 16.

FIG. 4 shows an example how the tulip-shaped contact 42 and the sleeve 46 can be mounted on the grounding contact 12. The grounding contact 12 has a tapped portion 121 into which the contact 42 screws by means of a threaded outside portion 421. The sleeve 46 is provided with an annular projection 461 clamped between an annular heel 442 of a ring 44 and a bottom end 422 of the contact 42, the ring 44 being provided with tapping 441 that co-operates with the thread 421 on the contact 42.

In the example shown, the grounding contact 16 is permanently in contact with the rod 16. In a variant, it is possible to provide a rod 16 that is set back from the grounding contact and that comes into contact with the grounding contact 12 only when grounding is achieved.

It is possible to mount the rod 16 to slide in the phase contact 14, and to move the rod 16 towards the grounding contact.

The phase contact 14 is disposed at a determined distance d from the grounding contact 12, and it is aligned therewith and with the rod 16 along the axis Y.

The phase contact 14 has a body 47 provided with a cavity 48 for receiving a first end 50 of the rod 16. Advantageously, the cavity 48 is provided with a tulip-shaped contact element 52 made of a conductive material, optionally identical to the material forming the element 42. The element 52 advantageously has a ring made of a material that withstands electric arcs. The element 52 is advantageously fastened in the cavity 48, e.g. by being screwed into the end wall of the cavity. Fastening by snap-fastening can also be imagined.

The phase contact 14 is secured to the mounting plate 6. In the example shown, the phase contact 14 is mounted on a support plate 54 that is fastened via a first end 56 to a second end 36 of the rod 20 and via a second end 58 to at least one pin 60 secured to the mounting plate 6.

Figure 2:
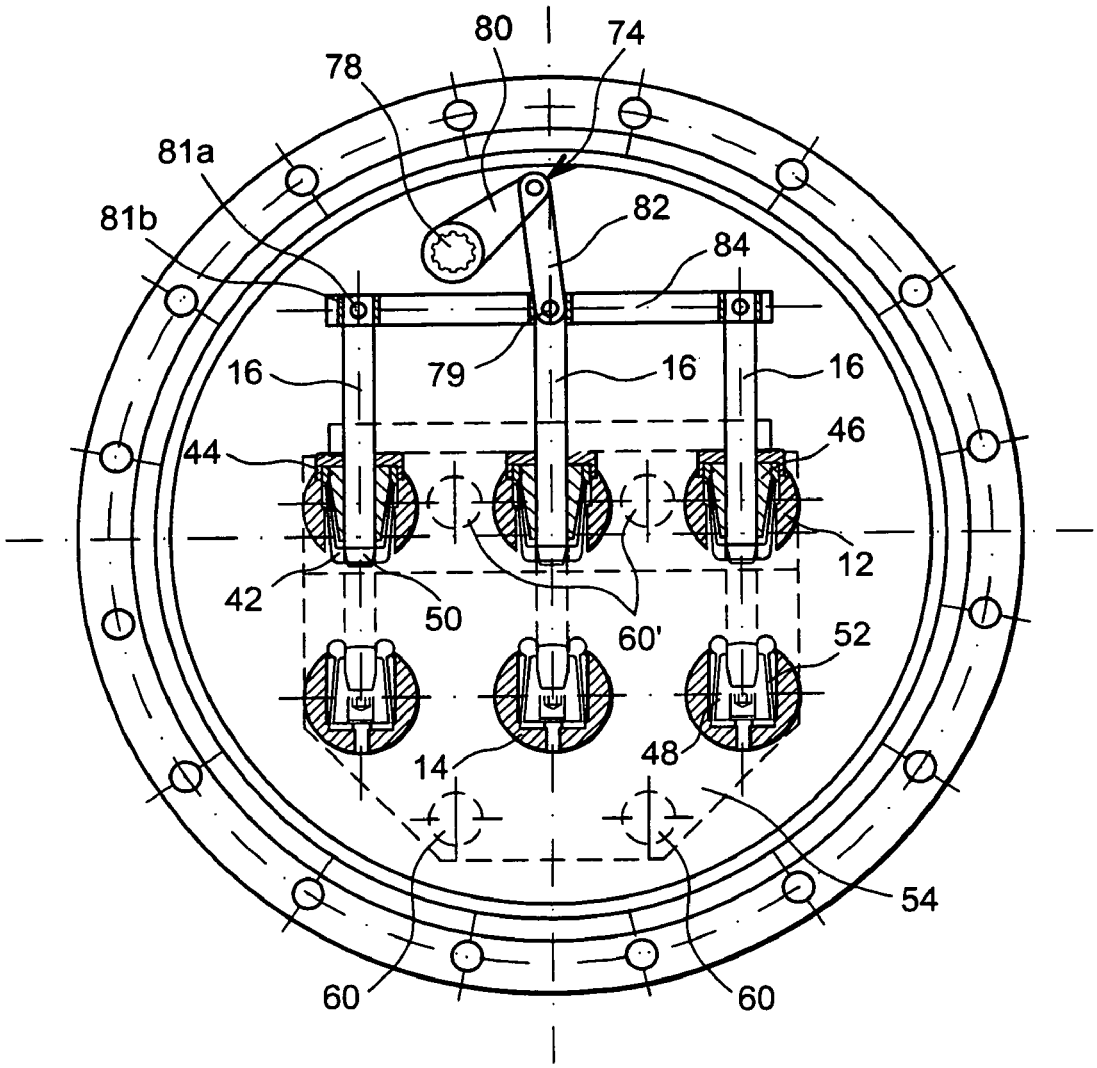
FIG. 2 is a view from above and partially in section of the disconnector of FIG. 1.

In FIG. 2, it is possible to see the support plate 54 in dashed lines, on which plate the three phase contacts 14 are mounted.

In the example shown, the support plate 54 is fastened to the mounting plate 6 by two pins 60 and by the three rods 20. As shown in FIG. 2, two additional pins 60' are provided. They are disposed between the grounding rods 20 and they connect the support plate 54 to the mounting plate 6, thereby making it possible to reduce the mechanical stresses on the grounding rods 20.

The support plate 54 is made of an insulating material so as to withstand the operating and testing voltages of the busbar 8.

The phase contact 14 is designed to be connected to a corresponding busbar 8, while the mounting plate 6 is being mounted onto the casing 2.

Advantageously, automatic connection of the phase contact 14 and of the busbar 8 is provided. For this purpose, the phase contact 14 can have a connector such as the connector described in Document FR 2811147, which is in the shape of a cylinder provided with fingers covered with a conductive material.

The phase contact 14 is disposed on the mounting plate 6, so that, on assembly, it is aligned with the connection portion of the busbar 8.

Thus, while the mounting plate 6 is being fastened onto the casing 2, the connector penetrates automatically into the connection element 101 that is fastened to the busbar 8, thereby avoiding any additional action to establish said connection and thus any additional opening for reaching the inside of the casing.

The disconnector is also provided with an actuator device 62 for actuating the moving connection means 16, which device is advantageously mounted on the mounting plate 6. In a variant, said actuator device could also be disposed on the casing 2.

The disconnector has a shaft 64 suitable for being driven by a drive shaft (not visible) of the actuator device 62. The driven shaft 64 is mounted to pivot freely by means of bearings 68 in a passageway 66 provided through the mounting plate 6 and substantially perpendicularly thereto. The shaft 64 pivots in gastight manner, and for this purpose, sealing means 70, e.g. O-ring seals, are mounted in grooves provided in the periphery of the shaft 64.

Grooves provided in the wall of the passageway 66 are also imaginable.

The shaft 64 is provided with an abutment 72 on the inside and on the outside of the mounting plate so as to hold said shaft 64 axially.

The shaft 64 is connected via a first end (not shown) to activation means mounted on the outside face of the mounting plate 6. The activation means can be of the electrical type.

The disconnector also has a connecting rod mechanism 74 (FIG. 2) connected to a second end 78 of the shaft 64 and to an end 79 of the rod 16 that is opposite from the end designed to come to penetrate into the cavity 48 of the phase contact 14.

The connecting rod mechanism 74 includes a first lever 80 constrained via a first end to pivot with the shaft 64, and a second lever 82 mounted to pivot freely on a second end of the first lever 80 and on the end 79 of the rod 16.

The rod 16 is electrically insulated from the second lever 82, e.g. by means of sleeves 81*a*, 81*b* made of an electrically insulating material.

Thus, the pivotal movement of the shaft 64 is transformed into movement in translation of the rod 16.

In the example shown in FIG. 2, the three ends 79 of the rods 16 are connected to a common transverse bar 84 to which the second lever 82 is hinged. Thus, actuating the shaft 64 makes it possible to move all three rods 16 simultaneously.

However, it is possible to provide a separate actuator mechanism for each rod 16, i.e. for each grounding assembly.

As described above, it is also possible to make provision to fasten the actuator device 62 to the casing 2; said actuator device could, for example, be formed by a pusher disposed axially behind the rod 16 relative to the contacts 12 and 14.

The mounting plate 6 is designed to be fastened to the casing 2 so as to close off the opening 4 in tight manner. The opening 4 is edged by an annular face 86 forming an abutment for the outside edge of the mounting plate 6. Sealing means 87 are interposed between the face 86 and the outside edge of the mounting plate 6.

As can be seen, the connecting rod mechanism 74, the rod 16, and the grounding contact 12 and the phase contact 14 lie substantially in the same plane parallel to the mounting plate 6. This makes it possible to have a relatively plane configuration for the grounding portion of the disconnector.

Distance D between the mounting plate 6 and the plane in which the grounding assembly moves can be chosen to be relatively small, while nevertheless taking account of a minimum isolation distance between the phase contact 14 and the mounting plate 6.

For example, the following dimensions can be given for an assembly according to the invention for a grounding disconnector for which the withstand voltage is 275 kV, filled with a dielectric gas, such as SF6 under a rated pressure of 6.36 bars.

Distance D between axis Y and face 18 is 97 mm; distance d between a free end 90 of the phase contact 14 facing the inner face of the mounting plate 18 and face 18 is 55 mm.

For a withstanding voltage of 375 kV, distance D between axis Y and face 18 can be 117 mm; distance d between a free end 90 of the phase contact 14 facing the inner face of the mounting plate 18 and face 18 can be 65 mm.

These dimensions and the connection length between 101 and 54 depend on here above parameters, and to a less extent, on the shape and the area of the electrodes.

Therefore, distance D corresponds to the thickness of the grounding mechanism in the chamber. This thickness is lower than the thickness of the mechanism disclosed in document US 2004/0042158

The present invention makes it possible to reduce the number of places where sealing is to be provided, and thus to reduce the risks of the dielectric gas leaking.

In addition, for maintenance purposes, it suffices to remove the mounting plate 6, without having to disassemble other parts of the disconnector.

In addition, the number of elements is small, which makes it possible to reduce the cost of a grounding disconnector.

The present invention also makes it possible to have a large amount of freedom as regards mounting and positioning the grounding disconnector, and as regards the configuration of the electrical switchgear as a whole.

Operation of this disconnector of the present invention is explained below.

In order to connect the busbar 8 to ground, the shaft 64 is caused to pivot about its axis by the drive means 62 disposed outside the casing 2, thereby causing the connection means 16 to slide towards the phase contact 14. The end of the rod 16 then penetrates into the contact element 52. The rod 16 then establishes electrical connection between the grounding contact 12 and the phase contact 14 (FIG. 2, in dashed lines), and grounds the busbar 8 connected to the phase contact 14.

A method of manufacturing such a grounding disconnector is also described below.

The manufacturing method comprises the following steps:

a) fastening at least one set of parts to a mounting plate 6, said set comprising a grounding contact 12, a phase contact 14, and moving electrical connection means 16 for electrically connecting the phase contact 15 to the grounding contact 12;

b) fastening the mounting plate 6 to a casing 2 having at least one busbar 8.

Advantageously, the phase contact 14 is connected to the busbar 8 automatically on mounting the assembly 6 onto the casing 2.

During step a), provision can also be made to fasten a displacement mechanism 62 for moving the connection means 16 onto the mounting plate 6.

During step b), sealing means 87 are interposed between the mounting plate 6 and the casing 2.

The invention claimed is:

1. An assembly for a grounding disconnector, said assembly comprising a stationary grounding contact, a phase contact suitable for being connected electrically to a busbar, moving connection means suitable for putting the stationary grounding contact and the phase contact into electrical contact with each other, the stationary grounding contact, the phase contact and the moving connection means being mounted on a mounting plate, the assembly further comprising an actuator device for actuating the moving connection means mounted on the mounting plate and a pivot shaft suitable for being caused to move by the actuator device, said pivot shaft passing through the mounting plate and a connecting rod mechanism connected via a first end to the shaft and via another end to the moving connection means so as to transform the pivotal movement of the shaft into a movement in translation of the moving connection means.

2. An assembly according to claim 1, in which pivot shaft is mounted substantially perpendicularly to the mounting plate, and the moving connection means and the connecting rod mechanism lie in a plane that is substantially parallel to the mounting plate.

3. An assembly according to claim 1, in which the phase contact has a connector for electrically connecting together the phase contact and the busbar.

4. An assembly according to claim 1, in which the moving connection means are formed by a rod, the stationary grounding contact is provided with a passageway for slidably receiving the rod, and the phase contact is provided with a cavity for receiving one end of the rod.

5. An assembly according to claim 1, in which a grounding disconnector with a withstanding voltage equal to 275 kV, 325 kV respectively, and a rated pressure of dielectric gas, such as SF6, equal to 6.3 bars, distance between an inner face of the mounting plate and a moving connection is 97 mm, 117 mm respectively, and distance between a free end of the phase contact facing the inner face of the mounting plate at said inner face is 55 mm, 65 mm respectively.

6. An assembly according to claim 4, in which the grounding contact has a tulip-shaped connection element mounted in the passageway, said connection element being made of an elastic conductive material, such as a copper-chromium alloy.

7. An assembly according to claim 6, in which said tulip-shaped connection element is fastened by being screwed into the passageway in the grounding contact.

8. An assembly according to claim 7, in which the grounding contact has a guide sleeve disposed inside the tulip-shaped connection element, said guide sleeve being held by being clamped between the tulip-shaped connection element and a ring screwed onto said tulip-shaped element.

9. An assembly according to claim 8, in which the guide sleeve is made of a thermoplastic material, e.g. polyethylene-terephthalate.

10. An assembly according to claim 1, comprising three stationary grounding contacts associated with respective phase contacts and with respective moving connection means, said moving connection means being suitable for moving along parallel axes.

11. An assembly according to claim 10, said assembly having a single actuator device and a single pivot shaft for all three moving connection means.

12. An assembly according to claim 11, taken in, having one pivot shaft for each moving connection means.

13. A gas-insulated grounding disconnector comprising a casing, at least one busbar, and at least one assembly comprising a stationary grounding contact, a phase contact suitable for being connected electrically to a busbar, moving connection means suitable for putting the stationary grounding contact and the phase contact into electrical contact with each other, the stationary grounding contact, the phase contact and the moving connection means being mounted on a mounting plate, the assembly further comprising an actuator device for actuating the moving connection means mounted on the mounting plate and a pivot shaft suitable for being caused to move by the actuator device, said pivot shaft passing through the mounting plate and a connecting rod mechanism connected via a first end to the shaft and via another end to the moving connection means so as to transform the pivotal movement of the shaft into a movement in translation of the moving connection means, closing off an opening in the casing in gastight manner.

14. A disconnector according to claim 13, in which the busbar has a connection portion for connection to the phase contact.

15. A method of manufacturing a grounding disconnector comprising the following steps:

a) mounting at least one set of parts comprising a stationary grounding contact, a phase contact, and moving connection means onto a mounting plate; and b) fastening said mounting plate onto a casing and automatically electrically connecting said phase contact to a busbar contained in the casing, wherein the grounding disconnector further comprises moving connection means suitable for putting the stationary grounding contact and the phase contact into electrical contact with each other, an actuator device for actuating the moving connection means mounted on the mounting plate, and a pivot shaft suitable for being caused to move by the actuator device, said pivot shaft passing through the mounting plate and a connecting rod mechanism connected via a first end to the shaft and via another end to the moving connection means so as to transform the pivotal movement of the shaft into a movement in translation of the moving connection means, closing off an opening in the casing in a gastight manner.

16. A method of manufacturing a grounding disconnector according to claim 15, further comprising, during step a), mounting a pivot shaft for actuating the moving connection means and an actuator device for moving the shaft onto the mounting plate.

17. A method of manufacturing a grounding disconnector according to claim 15, in which, during step b), sealing means are interposed between the mounting plate and the casing.

* * * * *